US010234816B2

(12) United States Patent
Miyamoto

(10) Patent No.: US 10,234,816 B2
(45) Date of Patent: Mar. 19, 2019

(54) IMAGE FORMING APPARATUS WITH CONDUCTIVE HANDLE

(71) Applicant: KYOCERA Document Solutions Inc., Osaka-shi, Osaka (JP)

(72) Inventor: Naruyuki Miyamoto, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/443,957

(22) Filed: Feb. 27, 2017

(65) Prior Publication Data

US 2017/0248903 A1 Aug. 31, 2017

(30) Foreign Application Priority Data

Feb. 29, 2016 (JP) ..... 2016-036923

(51) Int. Cl.
*G03G 21/16* (2006.01)

(52) U.S. Cl.
CPC ..... *G03G 21/1633* (2013.01)

(58) Field of Classification Search
CPC . G03G 21/1633; E05B 15/0073; E05B 47/00; E05B 7/20; E05C 19/165; E05C 19/166; E05C 17/56
USPC ..... 399/107; 292/251.5; 16/412; 312/222
See application file for complete search history.

(56) References Cited

U.S. PATENT DOCUMENTS 5,339,133 A 8/1994 Otomo et al.
5,825,605 A * 10/1998 Sutherland ..... B60R 16/06 361/216
2005/0056046 A1* 3/2005 Lee ..... F25D 23/028 62/440
2005/0095032 A1* 5/2005 Murano ..... G03G 21/1633 399/107

(Continued)

FOREIGN PATENT DOCUMENTS

DE 19745869 A1 * 5/1998 ..... B60J 5/00
JP S5577399 U 5/1980
JP 63265251 A * 11/1988

(Continued)

OTHER PUBLICATIONS

Japanese Patent Office, Office Action Issued in Application No. 2016036923, dated Oct. 30, 2018, 6 pages.

(Continued)

*Primary Examiner* — Susan S Lee
(74) *Attorney, Agent, or Firm* — Alleman Hall Creasman & Tuttle LLP

(57) ABSTRACT

An image forming apparatus includes an image forming portion, a housing, and a cover member. The image forming portion is configured to form an image. The housing supports the image forming portion and has conductivity. The cover member includes a handle having conductivity and is opened when maintenance of the image forming portion is carried out. In the image forming apparatus, when the cover member is in a closed state, the handle is separated from the housing by a distance larger than a predetermined particular (Continued)

distance, and during a process of the cover member being opened and transitioning from the closed state to an open state, the handle contacts or comes close to the housing so as to be separated from it by a distance equal to or smaller than the particular distance.

3 Claims, 4 Drawing Sheets

(56) References Cited

U.S. PATENT DOCUMENTS

| | | | | |
|---|---|---|---|---|
| 2006/0187291 | A1* | 8/2006 | Asanuma | B41J 2/1752 347/104 |
| 2008/0163462 | A1* | 7/2008 | King | E05B 17/0033 16/412 |

FOREIGN PATENT DOCUMENTS

| | | | | |
|---|---|---|---|---|
| JP | 05303984 | A | * | 11/1993 |
| JP | H0590502 | U | | 12/1993 |
| JP | 07084499 | A | | 3/1995 |
| JP | 08164744 | A | * | 6/1996 |
| JP | 08170467 | A | * | 7/1996 |
| JP | 09091060 | A | * | 4/1997 |
| JP | 10046875 | A | * | 2/1998 |
| JP | 10172787 | A | * | 6/1998 |
| JP | 10217574 | A | * | 8/1998 |
| JP | 2001063178 | A | * | 3/2001 |
| JP | 2005225041 | A | | 8/2005 |
| JP | 2016215596 | A | * | 12/2016 |
| KR | 20090028886 | A | * | 3/2009 |

OTHER PUBLICATIONS

Japanese Patent Office, Office Action Issued in Application No. 2016036923, dated Aug. 7, 2018, 4 pages.

* cited by examiner

IMAGE FORMING APPARATUS WITH CONDUCTIVE HANDLE

INCORPORATION BY REFERENCE

This application is based upon and claims the benefit of priority from the corresponding Japanese Patent Application No. 2016-036923 filed on Feb. 29, 2016, the entire contents of which are incorporated herein by reference.

BACKGROUND

The present disclosure relates to an image forming apparatus that forms an image on a sheet.

An image forming apparatus such as a multifunction peripheral includes a cover member that is opened and closed when the user accesses an image forming portion and carries out maintenance to eliminate a paper jam or the like. Here, an electrostatic discharge may be generated when the user touches the inside of the image forming apparatus. In that case, a problem such as an erroneous operation of the control portion or a failure of an electric component may occur. On the other hand, according to a known technology, a handle provided on a cover portion is grounded via a housing so that a static electricity is removed when the user touches the handle.

SUMMARY

An image forming apparatus according to the present disclosure includes an image forming portion, a housing, and a cover member. The image forming portion is configured to form an image. The housing supports the image forming portion and has conductivity. The cover member includes a handle having conductivity and is opened when maintenance of the image forming portion is carried out. In the image forming apparatus, when the cover member is in a closed state, the handle is separated from the housing by a distance larger than a predetermined particular distance, and during a process of the cover member being opened and transitioning from the closed state to an open state, the handle contacts or comes close to the housing so as to be separated therefrom by a distance equal to or smaller than the particular distance.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the present disclosure. It should be noted that the following embodiment is an example of a specific embodiment of the present disclosure and should not limit the technical scope of the present disclosure.

Figure 1:
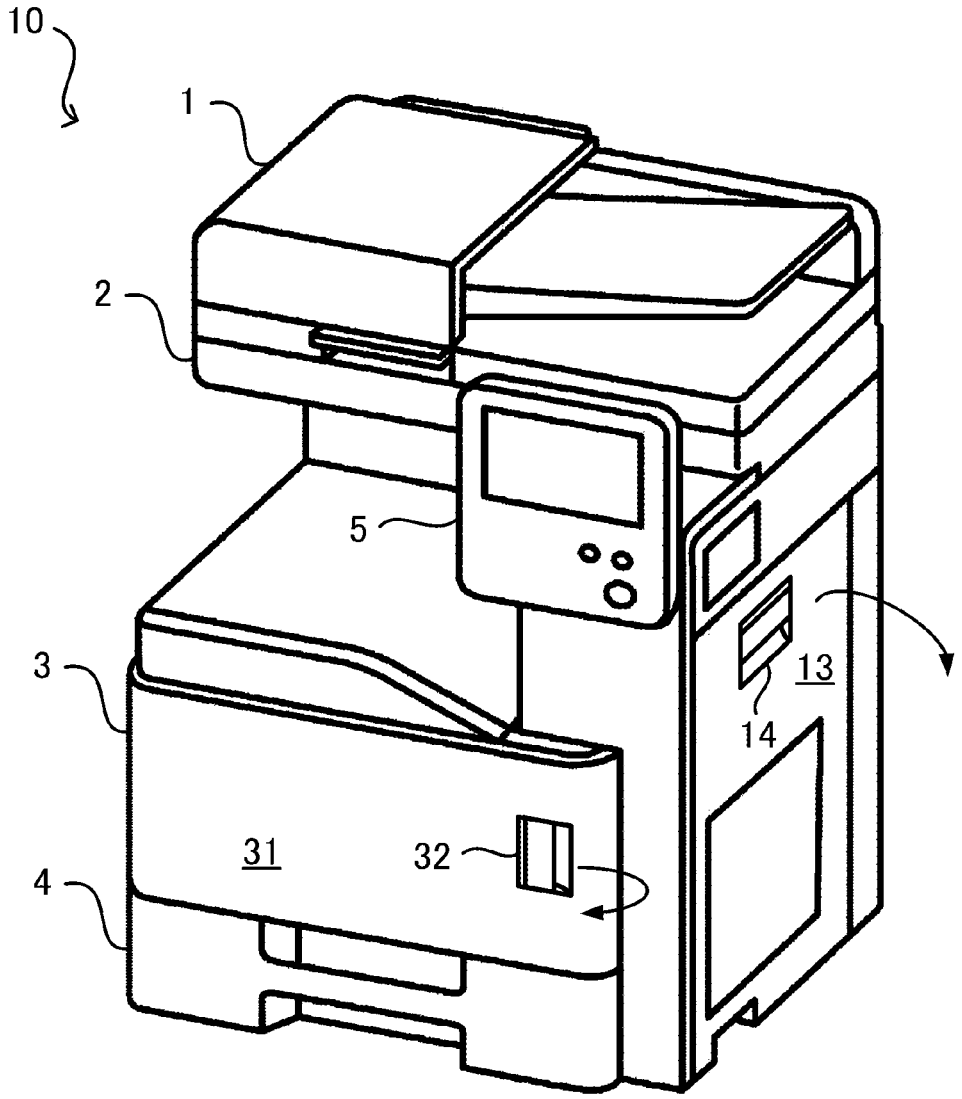
FIG. 1 is a perspective view of an image forming apparatus according to an embodiment of the present disclosure.

As shown in FIG. 1, an image forming apparatus 10 includes an ADF 1, an image reading portion 2, an image forming portion 3, a sheet feed cassette 4, and an operation portion 5. The image forming apparatus 10 is a multifunction peripheral having a plurality of functions such as a facsimile function and a copy function, as well as a scan function for reading image data from a document sheet, and a print function for forming an image based on image data.

In addition, the image forming apparatus 10 includes a control board and a power source, wherein on the control board, a control device such as a CPU for controlling the image forming apparatus 10 is mounted and, and the power source drives the image forming apparatus 10 by power supplied from a commercial AC power source. The image forming apparatus 10 further includes an electric component such as a temperature sensor for detecting temperature or a humidity sensor for detecting humidity.

The ADF 1 is an automatic document feeding device that includes a document sheet setting portion, a plurality of conveyance rollers, a document sheet presser, and a sheet discharge portion, and conveys a document sheet so that the document sheet can be read by the image reading portion 2. The image reading portion 2 includes a document sheet table, a light source, a mirror, an optical lens, and a CCD (Charge Coupled Device), and is configured to read an image from a document sheet and output the read image as image data.

The sheet feed cassette 4 is attached to the image forming apparatus 10 in a detachable manner. The sheet feed cassette 4 stores sheets that are to be supplied to the image forming portion 3. The operation portion 5 includes a display portion, a touch panel, and operation buttons, wherein the display portion is for example a liquid crystal display and displays information, and the touch panel and the operation buttons are configured to receive user operations.

The image forming portion 3 is an electrophotographic image forming portion configured to form an image on a sheet supplied from the sheet feed cassette 4 based on image data read by the image reading portion 2, or image data input from an external information processing apparatus.

Specifically, the image forming portion 3 includes a photoconductor drum, a charging device, a laser scanning unit (LSU), a developing device, a transfer roller, a cleaning device, and a fixing roller. It is noted that the image forming portion 3 may be a tandem-type image forming portion in which a plurality of image forming units corresponding to a plurality of colors are arranged side-by-side, and include an intermediate transfer belt to which images are transferred from the plurality of image forming units. It is noted that image forming portion 3 may be an inkjet image forming portion includes ink jet head.

In addition, as shown in FIG. 1, the image forming portion 3 includes a cover member 31 that covers the front side of the image forming portion 3 and can be opened and closed. The cover member 31 is opened when, for example, the user carries out maintenance to replace the toner cartridge or eliminate a paper jam. Specifically, the cover member 31 includes a handle 32 that the user holds when opening or closing the cover member 31. Holding the handle 32, the user opens the cover member 31 by pivoting it around a rotation axis that extends in the vertical direction.

Figure 2:
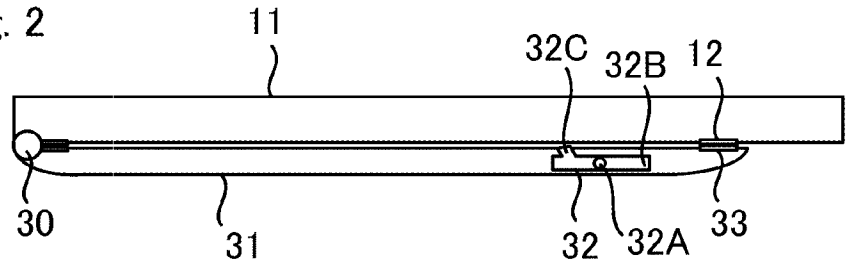
FIG. 2 is a schematic cross-sectional diagram showing a main part of the image forming apparatus according to the embodiment of the present disclosure.

Next, the configurations of the cover member 31 and the handle 32 are described with reference to FIG. 2. FIG. 2 is a schematic cross-sectional diagram showing a main part of the cover member 31 and the handle 32.

As shown in FIG. 2, a housing 11 of the image forming apparatus 10 and the cover member 31 are coupled with each other by a hinge portion 30. The cover member 31 can be opened and closed with respect to the housing 11 by being pivoted around the hinge portion 30 (rotation axis). The housing 11 of the image forming apparatus 10 supports at least the image forming portion 3, and is composed of a metal frame having conductivity. In addition, the housing 11 is electrically grounded.

Meanwhile, the handle 32 may be grounded when the cover member 31 is in a closed state. In that case, when the user touches the handle 32, an electrostatic discharge is generated and the user may be shocked by it. In addition, the handle 32 may be grounded via the hinge portion 30 of the cover member 31. In that case, the static electricity may not be removed due to an unstable conductive state of the hinge portion 30.

On the other hand, as described below, the image forming apparatus 10 can remove the static electricity without allowing the user to be shocked by the electrostatic discharge.

The handle 32 includes a pivot shaft 32A, a grip portion 32B, and a contact portion 32C and is made of a material having conductivity such as a metal. For example, the resistance value of the handle 32 is in a range from $10^6\Omega$ to $10^8\Omega$ or lower than the range.

The pivot shaft 32A is held by the cover member 31 and pivotably supports the handle 32. It is noted that an elastic member (not shown) such as a coil spring or a plate spring applies an elastic force to the grip portion 32B such that, as shown in FIG. 2, the contact portion 32C is kept to be separated from the housing 11 by a distance larger than a particular distance when the cover member 31 is in the closed state with respect to the housing 11. The grip portion 32B is one of opposite ends of the handle 32 that are opposed across the pivot shaft 32A, and is gripped by the user when opening or closing the cover member 31.

The contact portion 32C is the other of the opposite ends of the handle 32 that are opposed across the pivot shaft 32A, and is separated from the housing 11 and is not electrically grounded when the cover member 31 is in the closed state with respect to the housing 11 (see FIG. 2). More specifically, when the cover member 31 is in the closed state, the contact portion 32C of the handle 32 is separated from the housing 11 by a distance larger than the particular distance, wherein with the distance larger than the particular distance, an electrostatic discharge is not generated between the housing 11 and the contact portion 32C of the handle 32.

In addition, during a process of the cover member 31 being opened and transitioning from the closed state to an open state, the contact portion 32C comes close to the housing 11 so as to be separated by a distance equal to or smaller than the particular distance. More specifically, when the handle 32 pivots around the pivot shaft 32A, the contact portion 32C contacts the housing 11 and is electrically grounded. Here, the contact portion 32C has a plane surface that contacts the housing 11 by surfaces when the contact portion 32C contacts the housing 11. It is noted that the contact portion 32C may come into point contact with the housing 11 when contacting the housing 11. Furthermore, after the contact portion 32C contacts the housing 11 due to a pivot of the handle 32, the handle 32 can pivot to a position where the contact portion 32C applies a pressing force to the housing 11.

It is noted that in the present embodiment, the contact portion 32C of the handle 32 contacts the housing 11 when they are separated by the particular distance. On the other hand, the particular distance may be equal to or smaller than a predetermined distance, wherein an electrostatic discharge is generated between the contact portion 32C and the housing 11 when they are separated from each other by the particular distance.

In addition, the housing 11 has a magnet 12 and the cover member 31 has a magnet 33, wherein the magnet 12 and the magnet 33 are positioned so as to face each other when the cover member 31 is in the closed state. The cover member 31 is kept to be closed by attractive forces of the magnet 12 and the magnet 33, and is opened by the act of a force against the attractive forces. It is noted that only one of the housing 11 and the cover member 31 may be provided with a magnet, and the other may be provided with a magnetic substance such as iron.

Next, an opening operation of the cover member 31 is described with reference to FIG. 3 and FIG. 4.

In the opening operation of the cover member 31, first, the user grips the grip portion 32B of the handle 32 of the cover member 31. This allows the user and the handle 32 to have the same potential. At this time, the contact portion 32C of the handle 32 has not contacted the housing 11, and the handle 32 and the housing 11 are in a non-conductive state. As a result, an electrostatic discharge is not generated when the user touches the handle 32, and a shock due to an electrostatic discharge is not given to the user.

Figure 3:
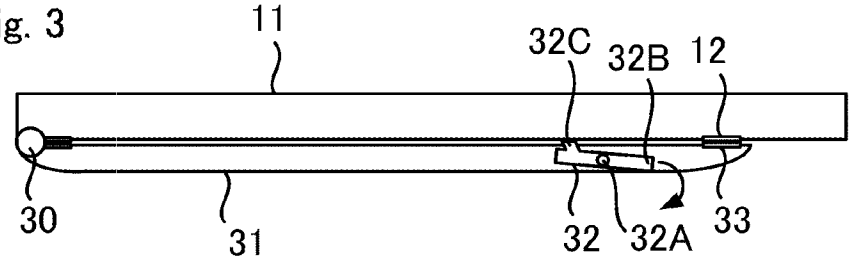
FIG. 3 is a schematic cross-sectional diagram showing the main part of the image forming apparatus according to the embodiment of the present disclosure.

Subsequently, as shown in FIG. 3, the user pulls out the grip portion 32B and causes the grip portion 32B to pivot around the pivot shaft 32A in the arrow direction. In the handle 32, this causes the contact portion 32C to pivot around the pivot shaft 32A, and the handle 32 and the housing 11 become in a conductive state since they contact each other. At this time, according to the present embodiment, a stable conductive state is obtained between the contact portion 32C and the housing 11 because they contact each other.

Here, if the handle 32 has been charged with static electricity by being gripped by the user, an electrostatic discharge is generated between the handle 32 and the housing 11 when the handle 32 contacts the housing 11. As a result, the static electricity is removed from the user without the user being shocked due to an electrostatic discharge.

Figure 4:
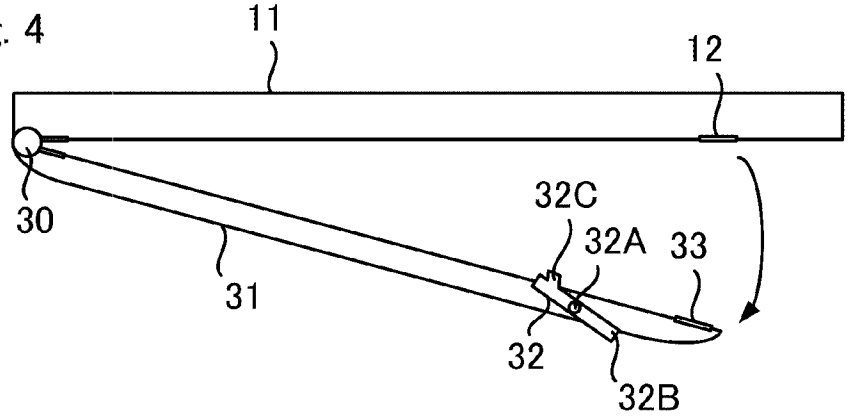
FIG. 4 is a schematic cross-sectional diagram showing the main part of the image forming apparatus according to the embodiment of the present disclosure.

Thereafter, as shown in FIG. 4, the user pulls out the cover member 31 by gripping the grip portion 32B, and causes the cover member 31 to pivot in the arrow direction around the hinge portion 30. Here, as described above, the handle 32 can pivot to a position where the contact portion 32C applies a pressing force to the housing 11. When the pressing force is applied to the housing 11 by the contact portion 32C as the handle 32 pivots, a force acts against the attractive forces of the magnet 12 and the magnet 33, and the force reduces a resistance to the user opening the cover member 31. When the cover member 31 is opened, the user can carry out maintenance to the image forming portion 3.

Furthermore, in the image forming apparatus 10, even if the user who is to open the cover member 31 has been charged with static electricity, the static electricity is removed from the user when he/she opens the cover member 31. As a result, when the user carries out maintenance of the image forming portion 3 or the like, even if the user touches the image forming portion 3 or the like, an electrostatic discharge is not generated, and thus it reduces the possibility of causing a problem such as an erroneous operation of the control portion of the image forming apparatus 10 or a failure of an electric component.

It is noted that as shown in FIG. 1, the image forming apparatus 10 may include a cover member 13 that covers a side of the image forming portion 3. The cover member 13, as is the case with the cover member 31, is opened when the user carries out maintenance to eliminate a paper jam or the like, and pivots around a horizontal direction when it is opened and closed. The cover member 13 includes a handle 14 that has the same configuration as the handle 32 of the cover member 31, and is used to open and close the cover member 13. With this configuration, when the user operates the handle 14 of the cover member 13, static electricity is removed from the user due to an electrostatic discharge from the handle 14 to the housing 11.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image forming portion configured to form an image;

a housing supporting the image forming portion and having conductivity; and a cover member including a handle having conductivity, and configured to be opened and closed by being pivoted around a rotation axis when maintenance of the image forming portion is carried out, wherein when the cover member is in a closed state, the handle is separated from the housing by a distance larger than a predetermined particular distance, and during a process of the cover member being opened and transitioning from the closed state to an open state, the handle contacts the housing when the handle is separated from the housing by the particular distance, the handle includes:

a pivot shaft pivotably supporting the handle;

a grip portion that is one of opposite ends of the handle that are opposed across the pivot shaft, and is gripped when the cover member is opened or closed; and a contact portion that is the other of the opposite ends of the handle that are opposed across the pivot shaft, is separated from the housing when the cover member is in the closed state, and contacts the housing when the handle pivots around the pivot shaft, and the contact portion projects slantwise in the vertical direction from the other of the opposite ends of the handle toward the housing, and has, at its tip, a plane surface that contacts the housing surface-to-surface when the handle pivots around the pivot shaft.

2. The image forming apparatus according to claim 1, wherein an electrostatic discharge is generated between the handle and the housing when the handle is separated from the housing by the particular distance.

3. The image forming apparatus according to claim 1, wherein the handle can pivot to a position where the contact portion applies a pressing force to the housing.

* * * * *